US005775190A

United States Patent [19]

Terai

[11] Patent Number: 5,775,190

[45] Date of Patent: Jul. 7, 1998

[54] FOOD SLICER

[75] Inventor: Masao Terai, Wakayama, Japan

[73] Assignee: Ryowa Co., Ltd., Wakayama, Japan

[21] Appl. No.: 618,605

[22] Filed: Mar. 20, 1996

[30] Foreign Application Priority Data

Mar. 22, 1995 [JP] Japan ..... 7-062918

[51] Int. Cl.[6] ..... B26D 5/26

[52] U.S. Cl. ..... 83/92; 83/355; 83/932

[58] Field of Search ..... 83/932, 409, 355, 83/350, 367, 92

[56] References Cited

U.S. PATENT DOCUMENTS

| | | | |
|---|---|---|---|
| 3,161,215 | 12/1964 | Werder et al. | 83/92 X |
| 3,530,915 | 9/1970 | Moriuchi et al. | 83/92 X |
| 3,824,885 | 7/1974 | Marshall et al. | 83/19 |
| 4,405,186 | 9/1983 | Sandberg et al. | 83/92 X |
| 4,428,263 | 1/1984 | Lindee et al. | 83/355 X |
| 4,457,194 | 7/1984 | Mally | 83/409 X |
| 4,522,093 | 6/1985 | Rattmann | 83/355 X |
| 4,760,765 | 8/1988 | Nishimoto et al. | 83/92 X |
| 4,913,019 | 4/1990 | Hayashi | 83/355 X |
| 5,136,906 | 8/1992 | Antonissen et al. | 83/367 X |

FOREIGN PATENT DOCUMENTS

| | | |
|---|---|---|
| 2-15357 | 1/1990 | Japan . |
| 2-106298 | 4/1990 | Japan . |
| 3-218418 | 9/1991 | Japan . |
| 7-108493 | 4/1995 | Japan . |

*Primary Examiner*—Maurina T. Rachuba

*Attorney, Agent, or Firm*—Wenderoth, Lind & Ponack, L.L.P.

[57] ABSTRACT

A food slicer includes an end detecting device for detecting end portions of a food fed by a feeder. A retaining member is arranged to be movable with the food in a feeding direction of the feeder and to be retractable at substantially a right angle to the feeding direction to penetrate into and depart from the food. A controller is responsive to a detection signal of the end detecting device for causing the retaining member to penetrate into and hold the other end of the food and to travel with the food until the other end of the food comes close to a rotary knife.

5 Claims, 12 Drawing Sheets

FOOD SLICER

BACKGROUND OF THE INVENTION

The present invention relates to a food slicer for slicing lumps of food, such as ham, sausage, or cheese.

Among such food slicers is a ham slicer which generally comprises a feeding means including a pair of belt conveyors arranged opposite to each other for holding and feeding downwardly a loaf of ham therebetween, and a cutting means for cutting with a rotary knife the loaf of ham fed from the feeding means into slices from its leading end.

Also, a conventional ham slicer of another type has a gripper for holding and feeding the trailing end of a loaf of ham in a given direction. In operation, the gripper has to repeat a gripping action to hold a succeeding loaf of ham during an interval between cutting of the current ham and cutting of a succeeding ham. This interval between the cutting actions interrupts a continuous procedure and will thus decrease the efficiency of production. On the other hand, the ham slicer with the belt conveyor type feeding means allows loafs of ham to be sliced continuously. As the belt conveyor feeding type ham slicer is higher in the efficiency of production, it is more widely used.

However, the ham slicer with the belt conveyor type feeding means has a disadvantage. The loaf of ham is stably held between the two belt conveyors when its main central portion which is substantially uniform in diameter remains lengthy. The holding of the load of ham will become unstable as the length of the central portion of the ham is decreased during cutting. Accordingly, as a trailing portion of the ham having a diameter smaller than that of the central portion comes close to the cutting means, the holding strength of the two belt conveyors is lessened. This may result in tilting of the ham due to, e.g., a load from the rotary knife of the cutting means. If the ham is tilted, it is cut diagonally to yield defective slices from the central portion where normal slices are commonly produced, as well as non-standard slices from both leading and trailing end portions of the ham. The productivity of satisfactory ham slices will thus be decreased.

It is an object of the present invention, in view of the above predicament, to provide a food slicer having a feeding means of the belt conveyor type and adapted for holding a lump of food stably even when the food is shortened during cutting so as to avoid production of non-standard slices caused by tilting of the food and to increase productivity.

SUMMARY OF THE INVENTION

For achievement of the above object of the present invention, a food slicer having a feeding means including a pair of belt conveyors disposed opposite to each other for holding and feeding a lump of food therebetween and a cutting means for cutting the food fed by the feeding means into slices from one end thereof in succession includes an end detecting means for detecting end portions of the food fed by the feeding means. A retaining member is arranged to be movable with the food in a feeding direction of the feeding means and retractable at substantially a right angle to the feeding direction to penetrate into and withdraw from the food. A controlling means is responsive to a detection signal of the end detecting means to cause the retaining member to penetrate into and hold the other end of the food and to travel with the food until the other end of the food comes close to the cutting means.

The food slicer of the present invention allows the lump of food to be held and conveyed between the two belt conveyors of the feeding means to the cutting means and to be cut from the one end thereof into slices in succession. Upon the one end of the food conveyed by the feeding means being detected by the end detecting means, the retaining member moves forward and penetrates into the other end of the food in response to the detection signal of the end detecting means. The retaining member then holds and travels together with the food until the other end of the food arrives at the cutting means. Accordingly, when the lump of food becomes shorter while being slices by the cutting means, it will be held stably.

DETAILED DESCRIPTION OF THE INVENTION

One embodiment of the present invention will be described referring to the accompanying drawings.

Figure 1:
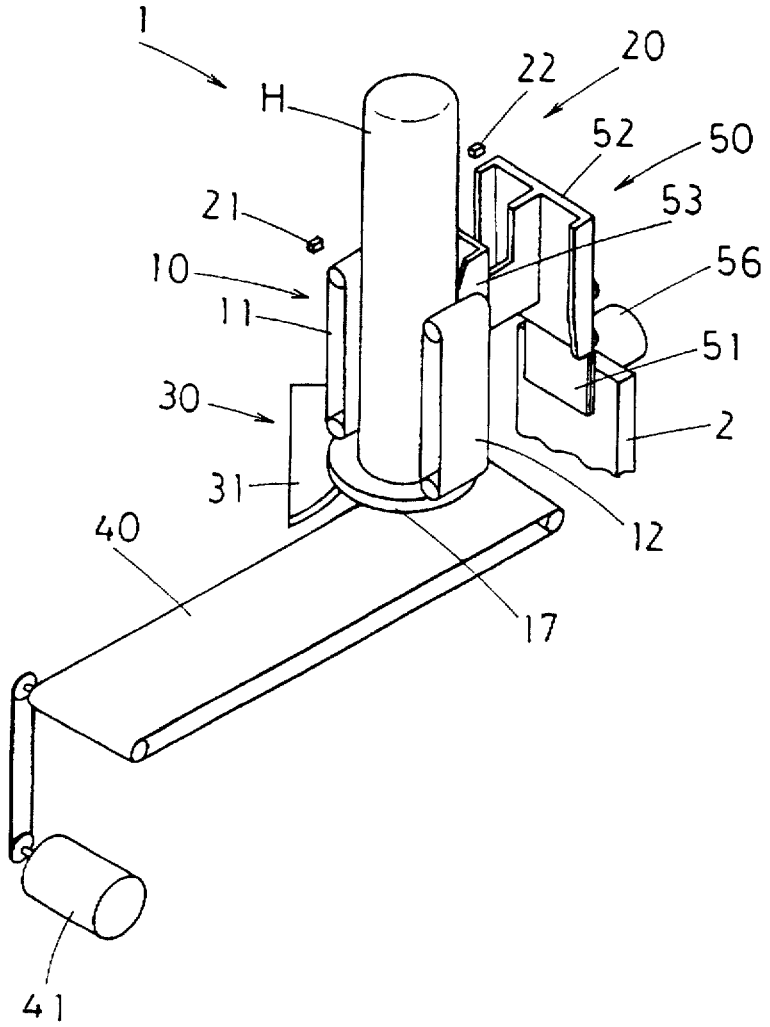
FIG. 1 is a schematic perspective view of a ham slicer showing one embodiment of the present invention.

The embodiment of the present invention is illustrated in the form of a ham slicer which is one mode of a food slicer. As shown in FIG. 1, the food slicer 1 comprises a feeding means 10 for conveying the load of ham H supplied as a lump of food, an end detecting means 20 for detecting both end portions of the ham H, a cutting means 30 for cutting the ham H fed by the feeding means 10 into slices in succession, a belt conveyor 40 for receiving and conveying slices of ham dropped from the cutting means 30 to the outside of the ham slicer 1, and a holding mechanism 50 for holding the ham H loaded by the feeding means with a retaining member (described later).

Figure 2:
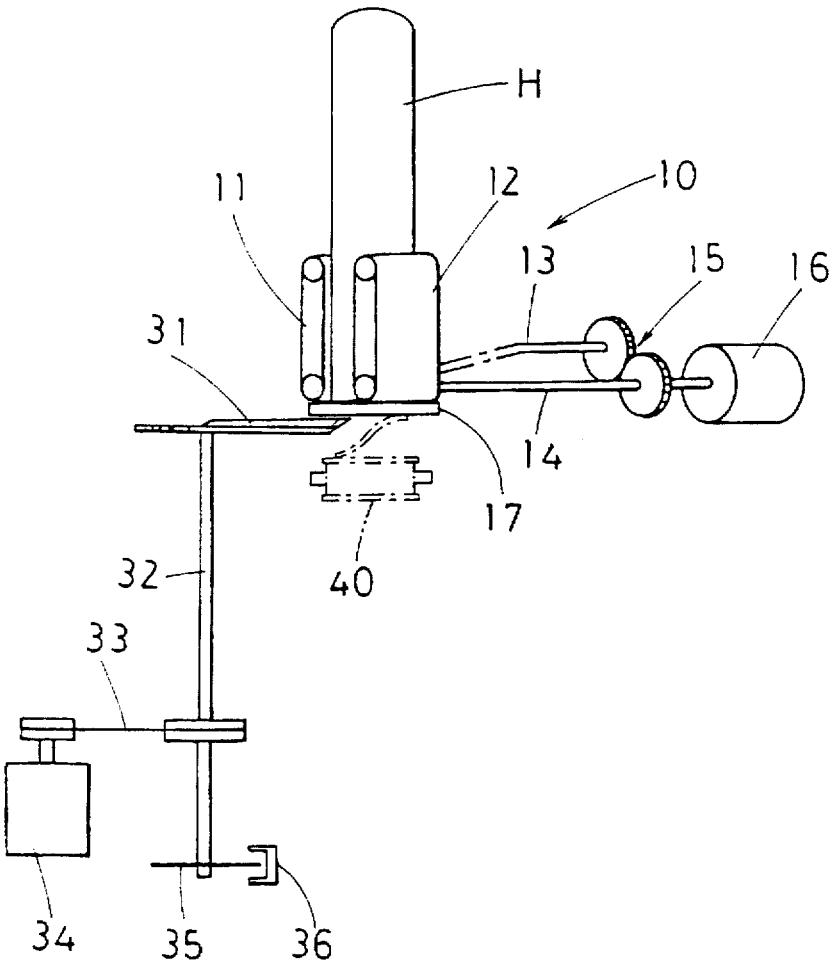
FIG. 2 is an explanatory view of drive mechanisms for a feeding means and a cutting means.
Figure 3:
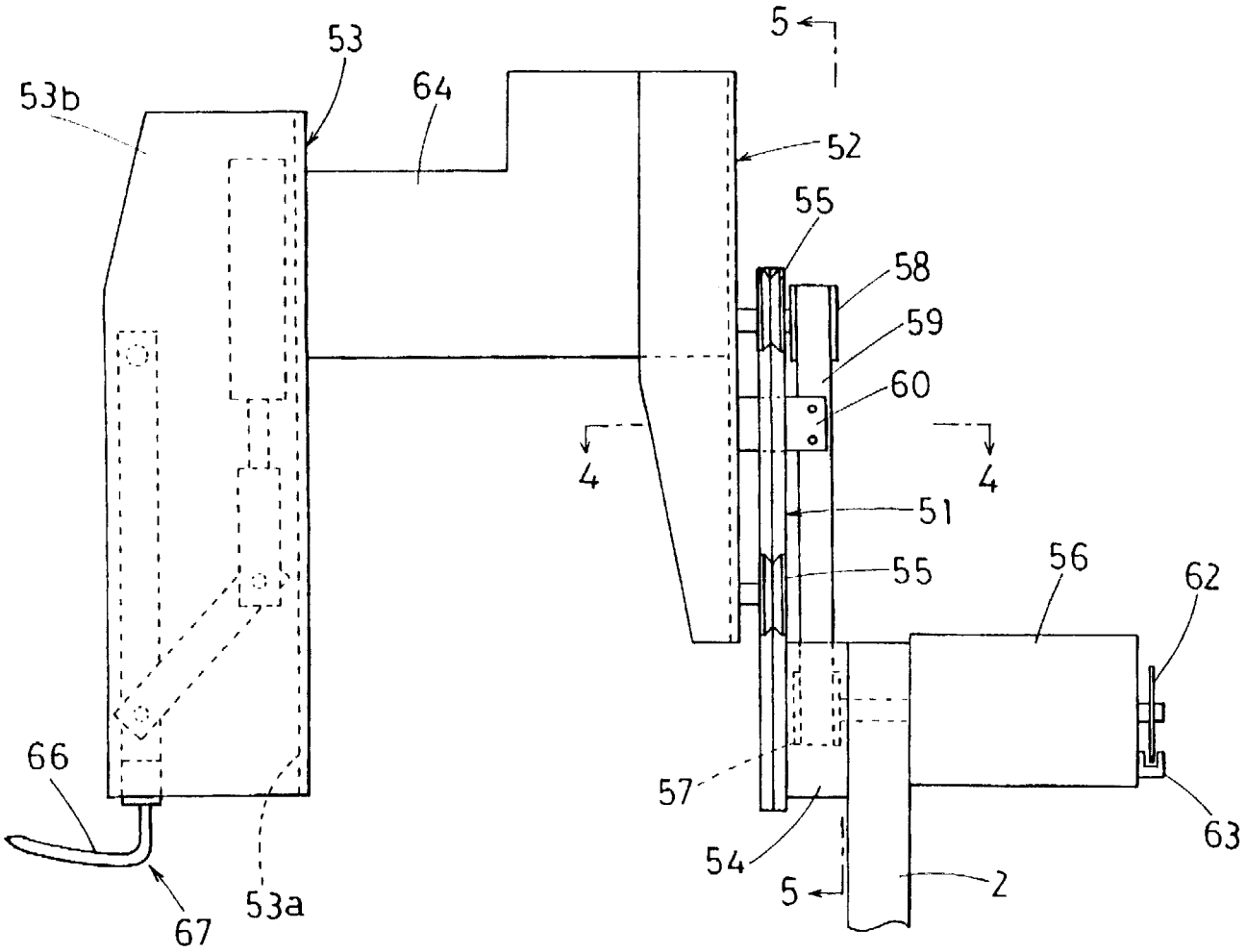
FIG. 3 is a side view showing a holding mechanism.
Figure 4:
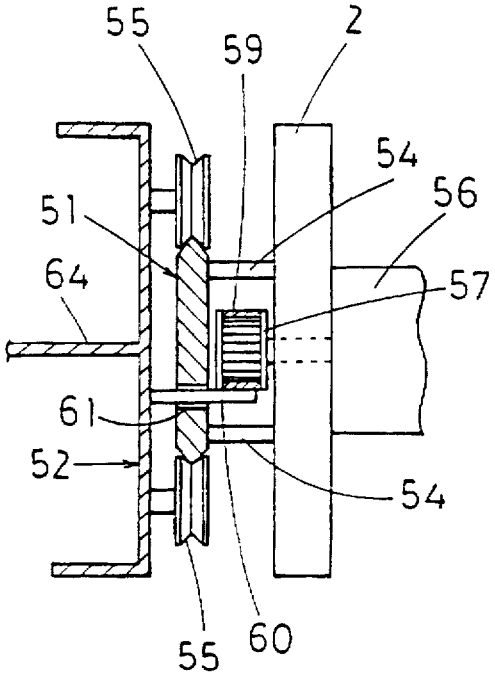
FIG. 4 is a cross sectional view taken along the line 4—4 of FIG. 3.
Figure 5:
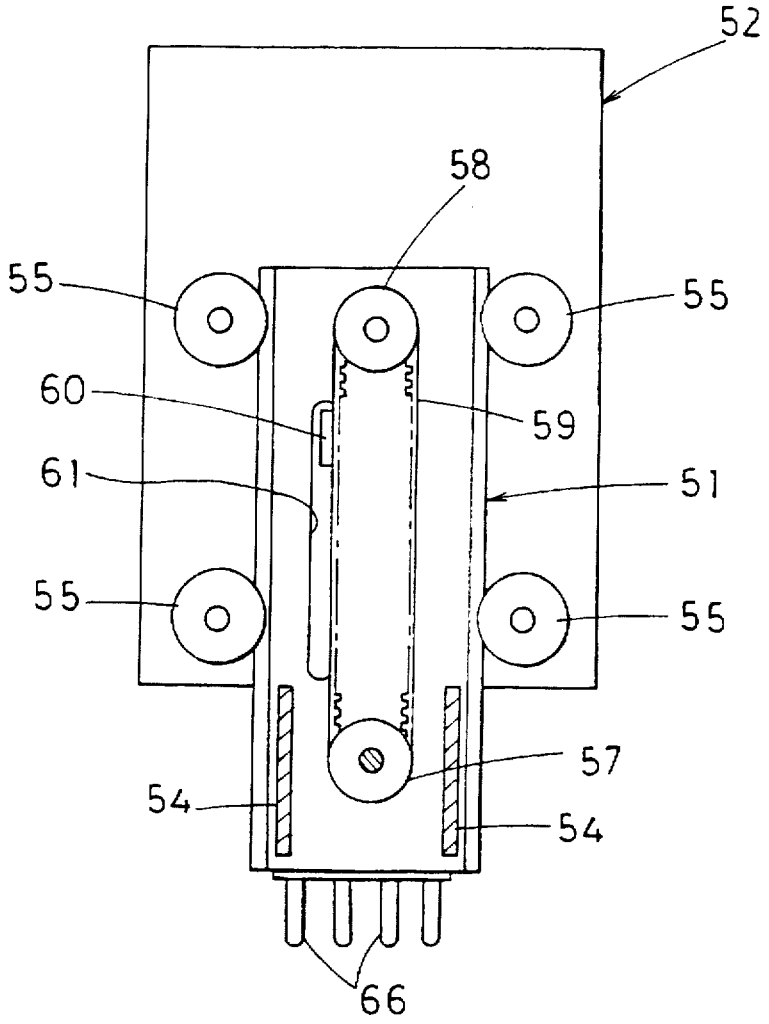
FIG. 5 is a cross sectional view taken along the line 5—5 of FIG. 3.
Figure 6:
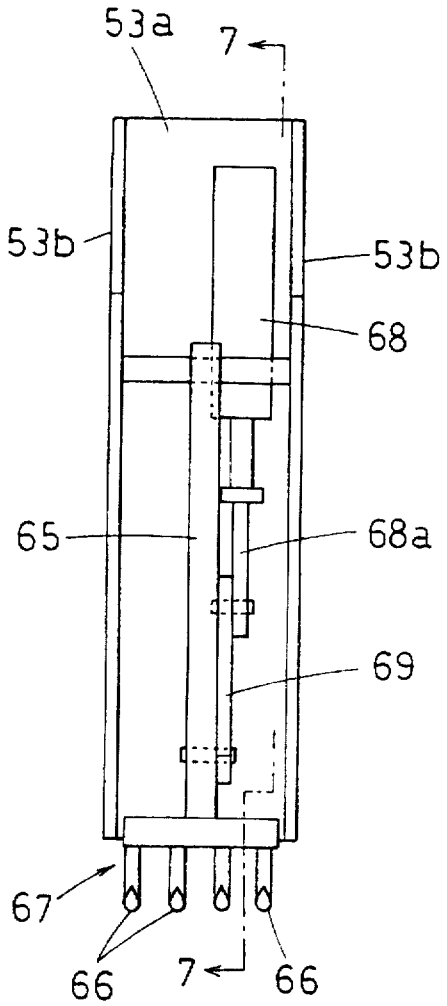
FIG. 6 is a front view of a holding base.
Figure 10:
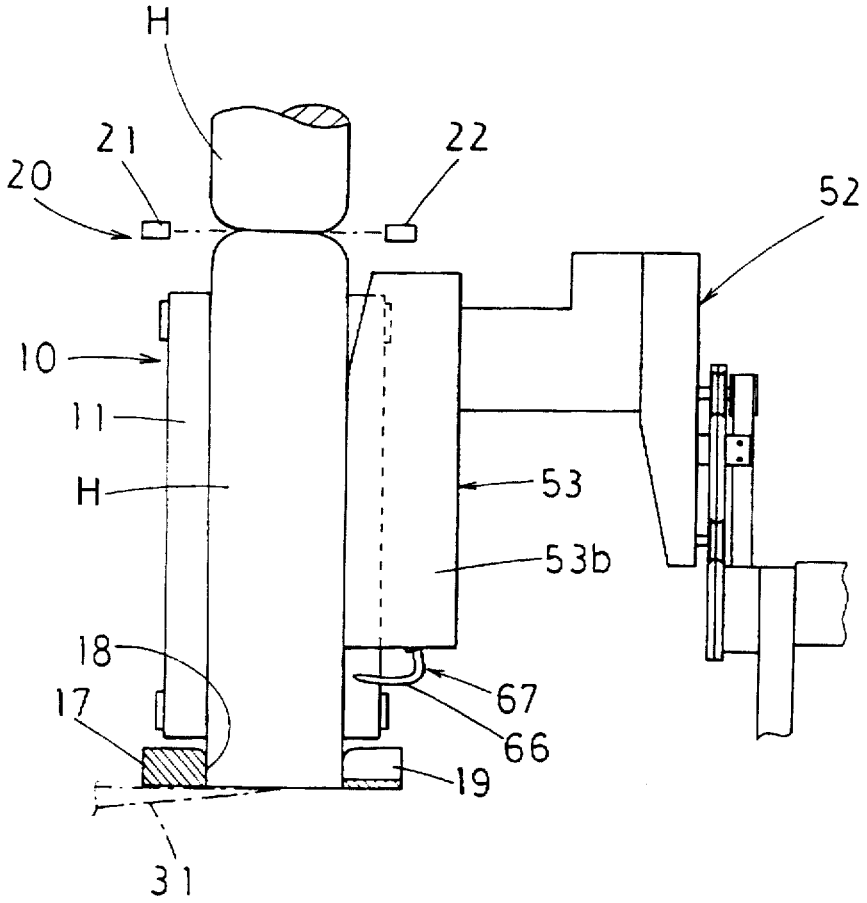
FIGS. 10 to 13 are explanatory views showing steps of operation of the ham slicer.

The feeding means 10 includes a pair of belt conveyors 11 and 12 disposed vertically opposite to each other to hold the ham H from opposite sides thereof. Referring to FIG. 2, the belt conveyors 11 and 12 are driven by two respective drive shafts 13 and 14 that are linked to each other by a pair of toothed wheels 15 for rotation at a constant speed in opposite directions to each other. The drive shaft 14 is coupled at the other end to a servo motor 16 for driving the belt conveyors 11 and 12 to feed the ham H in a downward direction. Also, a guide member 17 is disposed beneath the two belt conveyors 11 and 12. The guide member 17 has a thick disk shape having an opening 18 provided in the center thereof through which the ham H is passed and a downward groove provided in a top side thereof for clearing a retaining member (described later), as shown in FIG. 10. In addition, an automatic loader is provided above the feeding means for loading loafs of ham H one by one into the feeding means 10, and is not illustrated.

Figure 8:
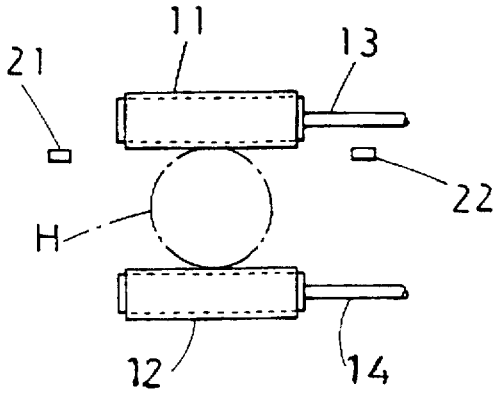
FIG. 8 is a schematic plan view showing an end detecting means.

The end detecting means 20 comprises a light emitter 21 and a light receiver 22 made of optical sensors. As is apparent from FIGS. 1, 8 and 10, the light emitter 21 and the light receiver 22 are arranged at a horizontal level which is slightly above the top end of the belt conveyor 11 and substantially perpendicular to the holding surface of the belt conveyor 11. As a leading portion of a ham H which is smaller in diameter than its central portion passes across such level, a beam of light emitted from the light emitter 21 which is generally interrupted by the central portion of the ham H and not received by the light receiver 22 passes to the light receiver 22 thus detecting the presence of the leading portion of the ham H.

The cutting means 30 includes a rotary knife 31 mounted adjacent to and beneath the feeding means 10. As shown in FIG. 2, the rotary knife 31 is driven by a drive shaft 32 which is linked by a pulley and belt mechanism 33 to a servo motor 34. The drive shaft 32 has a notched disk 35 mounted to the lower end thereof for allowing an optical sensor 36 to count rotations of the drive shaft 32 (thus, the rotary knife 31). The belt conveyor 40 is driven for rotating movement by a servo motor 41.

The holding mechanism 50 will not be explained referring to FIGS. 3 to 7.

The holding mechanism 50 includes a rail plate 51, a slide base 52, and a holding base 53. The rail plate 51 is vertically mounted by a spacer 54 to a platform 2 of the ham slicer 1 and has two sides shaped as a rail and having a triangular cross section. Four rollers 55, two on each side, are mounted on the back of the slide base 52. Rollers 55 each have a V-shaped circumferentially extending recess in a periphery thereof, and such recesses run directly on both sides of the rail plate 51. Thus, the vertical movement of the slide base 52 is supported by the rail plate 51. A timing belt 59 is mounted between a timing pulley 57 joined to an output shaft of a servo motor 56 and a timing pulley 58 mounted rotatably to an upper region of the back of the rail plate 51. A connecting strip 60 is mounted at one end to the back of the slide base 52. The other end of the connecting strip 60 is mounted to the timing belt 59. Strip 60 extends rearwardly of the rail plate 51 through a vertically extending slot 61 provided in the rail plate 51. This allows the slide base 52 to be moved vertically by rotation of the servo motor 56 while being guided by the rail plate 51.

The output shaft of the servo motor 56 has mounted on a rear end thereof a notched disk 62 for allowing an optical sensor 63 disposed opposite to the disk 62 to define the upper and lower limits of the vertical movement of the slide base 52.

The holding base 53 comprises a rear plate **53*a* and two side plates 53*b* forming substantially a C shape in cross section. The rear plate 53*a* is mounted to the front end of a connecting plate 64 extending forward from the front side of the slide base 52. As shown in FIGS. 1 and 10, the two side plates 53*b* of the holding base 53 are arranged to extend forward into between the holding surfaces of the two belt conveyors 11 and 12 so that they can support the side of the ham H fed between the two belt conveyors 11 and 12**.

Figure 7:
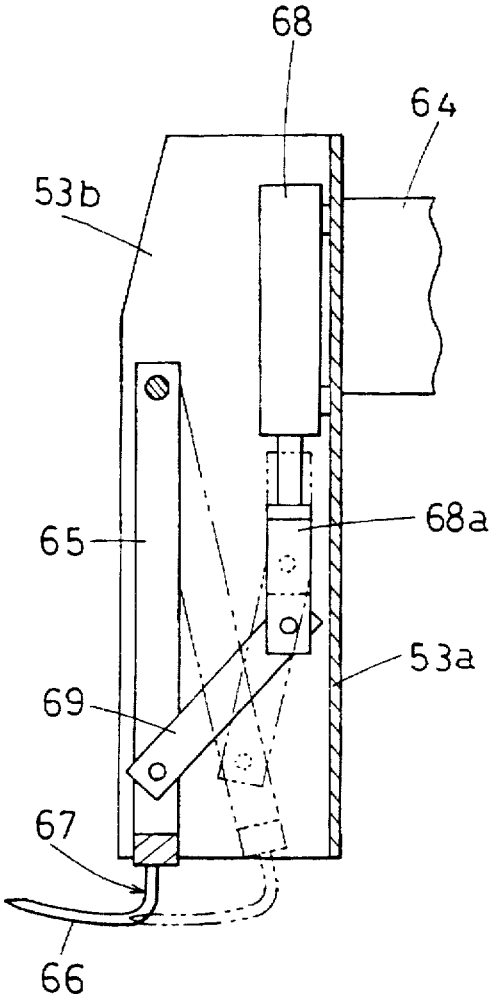
FIG. 7 is a cross sectional view taken along the line 7—7 of FIG. 6.

A swing arm 65 is pivotably mounted on the side plates **53*b* for forward and backward swing movements. A retaining member 67 having four forwardly bent claws 66 of a hook shape is mounted to the lowermost end of the swing arm 65. Also, an air cylinder 68 is mounted on the rear plate 53*a* of the holding base 53 and is connected to an air compressor (not shown). The air cylinder 68 is provided with a cylinder rod 68*a* which is pivotably linked to a lower end thereof with one end of a connecting rod 69. The other end of the connecting rod 69 is pivotably linked to the swing arm 65. Accordingly, as the cylinder 68 is actuated, the swing arm 65 is swung, thus to horizontally move the claws 66 of the retaining member 67 in forward and backward directions, as shown in FIG. 7**.

Figure 9:
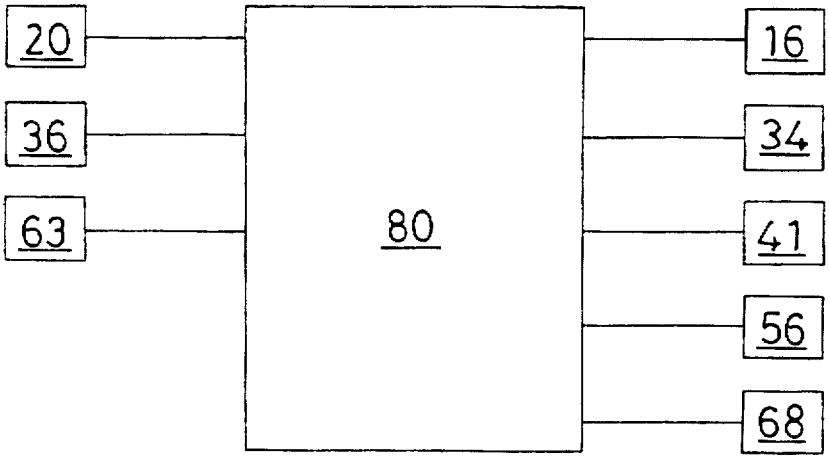
FIG. 9 is a schematic diagram of a controlling means.

FIG. 9 shows controlling means 80 installed in the ham slicer. The controlling means 80 is electrically connected to optical sensors 20, 36 and 63, the servo motors 16, 34, 41 and 56, and the air cylinder 68. The controlling means 80 may be a microcomputer having an input/output interface, a CPU, and memories (not shown) and accompanied with drivers (not shown) for the servo motors and a setting device (not shown) for controlling the thickness of a slice of the ham H.

The operation of the ham slicer 1 now will be explained. As the ham slicer 1 has been activated, the two belt conveyors 11 and 12 of the feeding means 10 and the rotary knife 31 of the cutting means 30 are driven to run at constant speeds. The load of ham H loaded from the automatic loader to the feeding means 10 is transferred downwardly between the two belt conveyors 11 and 12 to the cutting means 30. The ham H upon reaching the cutting means 30 is cut from its leading end by the rotary knife 31 into slices of a predetermined thickness which are then dropped onto and conveyed by the belt conveyor 40 to the outside.

At the start of operation, the slide base 52 and the holding base 53 remain at a standby or upstream position or an upper limit of the vertical movement determined by the optical sensor 63, as shown in FIG. 10. In the standby state, the air cylinder 68 is kept retracting and the retaining member 67 stays backward allowing claws 66 to be spaced from the ham H.

Figure 11:
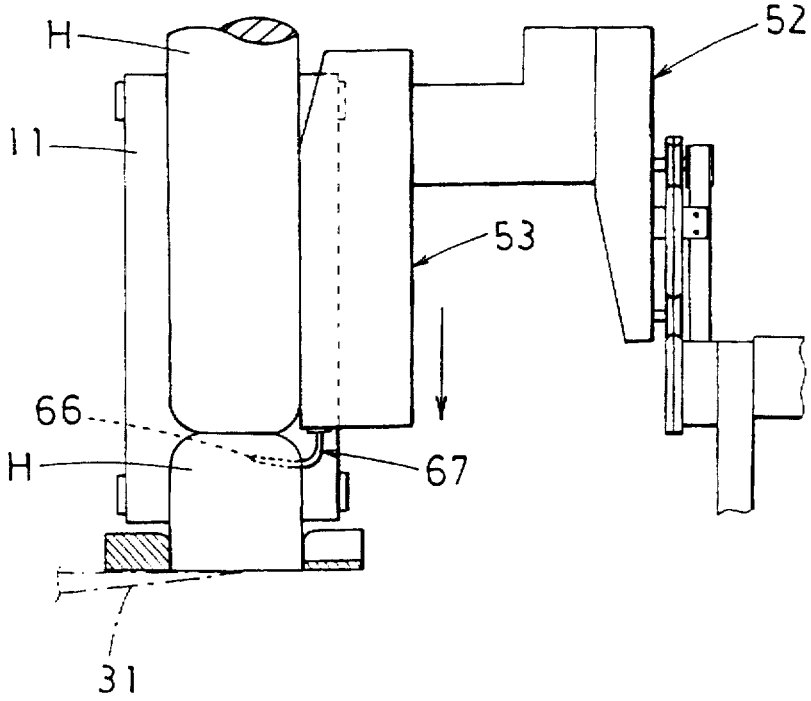

When the trailing portion of the ham H fed by the feeding means 10 comes to the end detecting means (optical sensor) 20 which in turn generates and transmits a detection signal to the controlling means 80, the controlling means 80 calculates a period of time to a moment when the trailing portion of the ham H reaches the level of the claws 66 with reference to the feeding speed of the feeding means 10. Upon such period of time having elapsed, the air cylinder 68 is actuated to move the retaining member 67 forward so that the claws 66 of the retaining member 67 penetrate into the ham H as shown in FIG. 11. Simultaneously, the controlling means 80 lowers the slide base 52 at a speed equal to the feeding speed of the feeding means 10 for feeding the ham H, allowing the retaining member 67 to move downward with the ham H.

Figure 12:
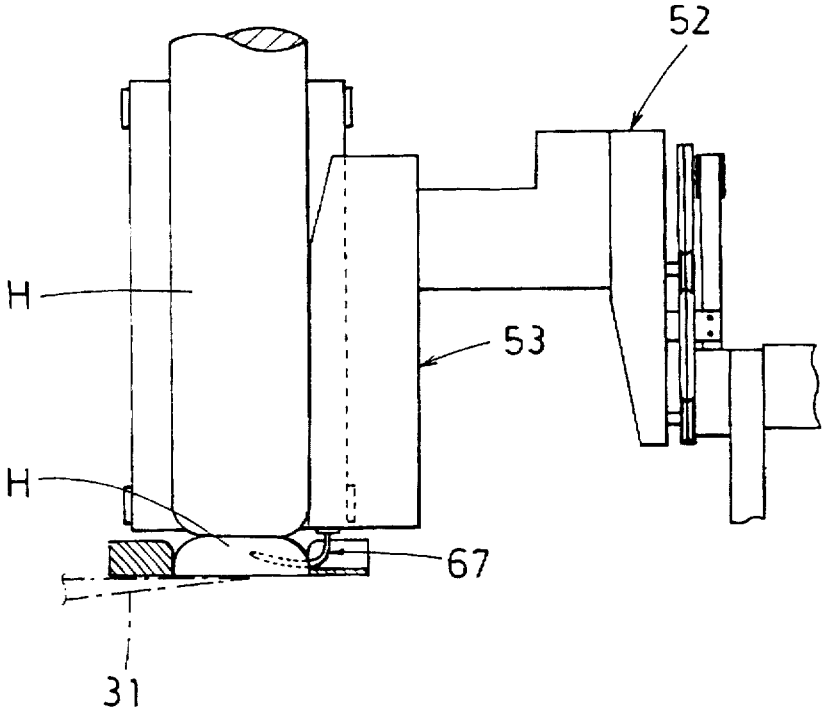

FIG. 12 shows the slide base 52 having been lowered and arrived at the lower limit or downstream position of its vertical movement with the retaining member 67 holding the ham H, such lower limit being determined by the optical sensor 63. At such time, the controlling means 80 causes the air cylinder 68 to retract with the retaining member 67 moved backward. This allows the claws 66 to withdraw from the ham H and the downward movement of the slide base 52 to be ceased. The trailing portion of the ham H into which the claws 66 previously penetrated involves production of non-standard slices, and when it is pressed downward by a succeeding loaf of ham H, it is sliced by the rotary knife 31 and dropped.

Figure 13:
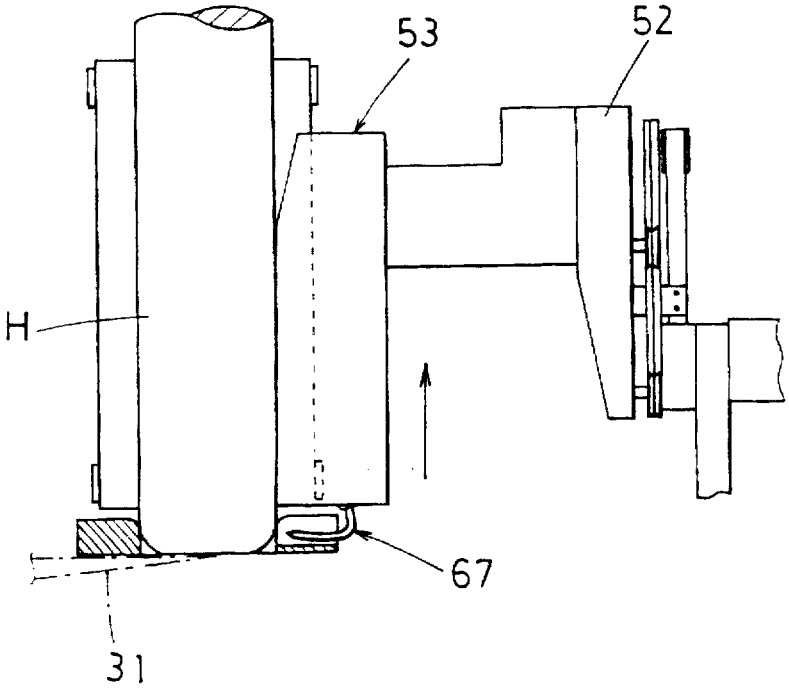

FIG. 13 shows that the trailing portion of the ham H has been sliced off and the leading end of the succeeding ham H has arrived at the cutting position of the rotary knife 31. The slide base 52 after stopping its downward movement starts its upward movement with the retaining member 67 kept backward and moves to its standby position, shown in FIG. 10, upon reaching the upper limit.

According to this embodiment of the present invention, the retaining member 67 causes its claws 66 to penetrate into and hold the trailing portion of the ham H, and to move together with the ham H until the trailing portion of the ham H arrives at the cutting position of the rotary knife 31. Hence, when the central portion of the ham H becomes short during the cutting operation, it is prevented from being tilted by an external force from, e.g., the rotary knife 31 and being cut into defective slices. As a result, the productivity of ham slices will be increased.

It would be understood that the ham slicer of the described embodiment is illustrative and that the present invention is applicable to other types of food slicers than a ham slicer. Also, the present invention is not limited to the downward feeding action of the feeding means in the illustrated embodiment but may be employed with a food slicer in which a lump of food is fed diagonally or horizontally by its feeding means. Although the retaining member in the illustrated embodiment is driven by a power device for movement with a lump of food, it may follow a lump of food and be driven by a force of the food derived from the feeding means.

The retaining member in the illustrated embodiment is not limited to a single member, but rather a pair of the retaining members may be arranged on opposite sides of a lump of food fed by the feeding means. As the food is held from both sides with two retaining members, it will be more stably maintained.

Although the retaining member departs from the food as it is moved backward, it may be arranged to retract together with the food and then be separated therefrom by an appropriate means.

What is claimed is:

1. A food slicer comprising:

a pair of belt conveyors positioned opposite to each other for holding therebetween a lump of food and feeding the lump of food in a feeding direction;

a cutter positioned downstream of said belt conveyors, relative to said feeding direction, for cutting a leading end, relative to said feeding direction, of the lump of food into successive slices;

end detecting means for, during feeding of the lump of food by said belt conveyors, detecting a trailing end, relative to said feeding direction of the lump of food, and for generating a signal representative thereof;

a holding mechanism movable in opposite directions parallel to said feeding direction between upstream and downstream positions, relative to said feeding direction, said holding mechanism including a retaining member movable in opposite directions substantially transverse to said feeding direction between a projected position, whereat said retaining member may be penetrated into the lump of food, and a retracted position, whereat said retaining member is withdrawn from the lump of food; and controlling means, responsive to said signal, for, during said feeding of the lump of food by said belt conveyors, causing movement of said retaining member from said retracted position to said projected position, such that said retaining member is penetrated into a trailing portion of the lump of food, and causing said holding mechanism and said retaining member to move from said upstream position to said downstream position.

2. A food slicer as claimed in claim 1, wherein said end detecting means is positioned upstream of said retaining member in said upstream position.

3. A food slicer as claimed in claim 2, wherein said controlling means is operable to delay movement of said retaining member from said retracted position to said projected position for a time period sufficient for the trailing portion of the lump of food to be moved by said belt conveyors in said feeding direction from said end detecting means to said retaining member.

4. A food slicer as claimed in claim 2, wherein said end detecting means is positioned upstream of said belt conveyors, and said retaining member is positioned downstream of said belt conveyors.

5. A food slicer as claimed in claim 1, wherein said controlling means is operable to move said holding mechanism from said upstream position to said downstream position in synchronism with movement of the lump of food in said feeding direction by said belt conveyors.

* * * * *